US005595610A

United States Patent [19]

Maeda et al.

[11] Patent Number: 5,595,610

[45] Date of Patent: Jan. 21, 1997

[54] METHOD OF MANUFACTURING CASE-HARDENED PARTS WITH LITTLE DISTORTION IN HEAT TREATMENT AND SUPERIOR STRENGTH IN BENDING FATIGUE

[75] Inventors: Hisao Maeda; Yoshitake Matsushima; Morifumi Nakamura; Akito Shiina, all of Kobe; Mikio Hirahara, Hiroshima; Yukio Arimi, Hiroshima; Yoshihiko Kojima, Hiroshima, all of Japan

[73] Assignees: Kabushiki Kaisha Kobe Seiko Sho, Kobe; Mazda Motor Corporation, Hiroshima, both of Japan

[21] Appl. No.: 589,581

[22] Filed: Jan. 22, 1996

Related U.S. Application Data

[63] Continuation of Ser. No. 237,318, May 3, 1994, abandoned, which is a continuation of Ser. No. 894,600, Jun. 5, 1992, abandoned.

[30] Foreign Application Priority Data

Jun. 7, 1991 [JP] Japan ..... 3-163507
Apr. 24, 1992 [JP] Japan ..... 4-131866

[51] Int. Cl.[6] ..... C22C 38/00

[52] U.S. Cl. ..... 148/233; 148/318; 148/319

[58] Field of Search ..... 148/233, 318, 148/319

[56] References Cited

U.S. PATENT DOCUMENTS

| | | | |
|---|---|---|---|
| 2,260,249 | 10/1941 | Harder | 148/233 |
| 4,157,258 | 6/1979 | Philip et al. | 148/319 |
| 4,495,004 | 1/1985 | Grilli et al. | 148/233 |
| 4,913,749 | 4/1990 | Hengerer et al. | 148/233 |
| 4,971,634 | 11/1990 | Shibata et al. | 148/233 |

FOREIGN PATENT DOCUMENTS

| | | | |
|---|---|---|---|
| 48-11224 | 2/1973 | Japan | 148/233 |
| 55-32777 | 8/1980 | Japan . | |
| 1-306545 | 12/1989 | Japan . | |
| 3-100142 | 4/1991 | Japan | 148/319 |

OTHER PUBLICATIONS

William C. Leslie, "The Physical Metallurgy of Steels, McGraw–Hill Book Company", 1981.

Leslie, W. C., The Physical Metallurgy of Steels, 1981, pp. 256–266.

*Primary Examiner*—Sikyin Ip

*Attorney, Agent, or Firm*—Oblon, Spivak, McClelland, Maier & Neustadt, P.C.

[57] ABSTRACT

A manufacturing method of case-hardened parts whose chemical components comprising especially Fe, C, Si, Mn, S, Ni, Mo, Al, V and N including a step of the heat treatment 1 in which, after carburizing, carbonitriding or carburizing followed by carbonitriding steel is cooled gradually at a temperature less than 100° C./minute, by another step of the heat treatment 2, in which steel is heated to a temperature higher than the $Ac_3$ transformation point and less than 850° C. and kept at the above temperature before quenching, or after keeping at the temperature, is cooled down to a level not below 600° C. before quenching, or quenching is done after cooling down to and keeping the temperature not below 600° C. is disclosed. This method makes the surface layer a mixture of martensite and retained austenite. Thus the case hardened steel products of high precision and high strength are obtainable.

6 Claims, 3 Drawing Sheets

METHOD OF MANUFACTURING CASE-HARDENED PARTS WITH LITTLE DISTORTION IN HEAT TREATMENT AND SUPERIOR STRENGTH IN BENDING FATIGUE

This is a Continuation of application Ser. No. 08/237,318, filed on May 3, 1994, now abandoned, which is a Continuation of application Ser. No. 07/894,600 filed Jun. 5, 1992, also abandoned.

CROSS-REFERENCES TO RELATED APPLICATIONS

Japanese Patent kohkoku 32777/1980

A technique of preventing intergranular oxidation in the carburized layer to thereby enhance the strength of steel products is disclosed.

Japanese Patent kohkai 306545/1989

A technique of preventing incomplete hardening in the carburized surface by raising the Mo content of steel to thereby enhance the strength of steel products is disclosed.

BACKGROUND OF THE INVENTION

1. Field of the Invention

The present invention relates to a method of manufacturing various structural parts of machines required to be especially high in surface hardness. This method is used, for example, in making various automobile parts, especially manufacturing case-hardened parts with little distortion in heat treatment and superior strength in bending fatigue by specifying the chemical composition of the steel material used and the conditions of heat treatment. The invention also relates to a method of manufacturing case-hardened parts whose dimensional precision is high due to minimun distortion in heat treatment such as automobile parts, e.g., automobile gears and the like. The method of the present invention is, however, not limited to manufacturing methods of automobile parts and is to be applicable to those all structural parts for the machinery whose fatigue strength must be excellent.

2. Description of the Related Technology

As automobiles have now come to be widely used in all corners of the globe, their influence on environmental problem is now being reviewed from a global point of view and today improvement of the output as well as fuel cost of automobile engine is being taken up urgently. As a means of solving this problem, it is now considered necessary to put emphasis on enhancing the strength and weight-reduction of automobile parts. To date, the present inventors have mede various attempts to improve the mechanical strength of parts, especially automobile gears and shafts. As such gears and shafts are cited, for example, transmission gears (final gears, for instance), differential gears (side gears, pinion gears etc.), drive gears of camshafts, hub sleeves and shafts. As the prior arts made from the above point of view may be cited, among others, the technique for preventing intergranular oxidation in the carburized layer by lowering the silicon content of steel (Japanese Patent kohkoku 32777/1980), the technique for preventing incomplete hardening of the surface of carburized layer by increasing the Mo content of steel (Japanese Patent kohkai 306545/1989) and the technique imparting the residual stress to the gear's root of tooth by shot peening after carburizing and tempering and improved steels of such kinds, represented by SCM420, SNCM420, etc are already marked.

Car users have expressd a strong desire for reducing of gear noise through running, this desire being stronger as car performance in general has been steadily improved.

The present inventors, therefore, made careful studies to trace the cause of gear noise and found out that the gear noise can be reduced substantially depending on the accuracy of size of the gears. An object of the present invention is, therefore, to provide a structural steel parts which are required to have a quite high hardness and are small in the distortion caused by the heat treatment. Another object of the present invention is to provide a method of manufacturing a case-hardened part excelled in dimensional precision as well as in bending fatigue strength due to reducing heat treatment-caused distortion such as a gear. Still a further object of the present invention is to provide an invention that can reduce the heat treatment-caused distortion of gears so as to provide both high precision and high strength through a study of steel's chemical composition and its metallographic structure. It is essential to use gears made of case-hardened steel of a specified chemical composition and do heat treatment under specific conditions.

SUMMARY OF THE INVENTION

The manufacturing method of case-hardened parts of the present invention is comprised of the following steps; carburizing, carbonitriding or carburizing followed by carbonitriding parts made of case-hardening steel, whose chemical composition is C: 0.03–0.27%, Si: 0.05–0.35%, Mn: 0.3–2.0%, S: 0.03% max., Ni: 0.4–3.0%, Mo: 0.1–1.0%, Al: 0.015–0.10%, V: 0.03–0.5%, and N: 0.004–0.02% balancing: Fe and inevitable impurities and the C-equivalent represented by the following formula in the range of 0.5–1.2(%), $$\text{C-equivalent}=[C]+(1/7.2)\,[Si]+(1/4.8)\,[Mn]+(1/7.5)\,[Ni]+(1/6.0)\,[Cr]+(1/5.8)\,[Mo]+(1/1.5)\,[V]$$

(In the above formula, each element symbol [ ] represents the content in weight percentage thereof.)

The parts of the present invention is slowly-cooled at a rate of 100° C./min., or less and then reheated to a temperature above the $Ac_3$ transformation point when the C-content of the steel used is 0.4%. The temperature is kept less than 850° C. before quenching and thereby making the surface layer substantially a mixture of martensite and retained austenite. It is also possible to heat to a temperature above the $Ac_3$ transformation temperature and less than 850° C., and after keeping at this temperature, the steel parts may be quenched after cooling once to a temperature not below 600° C. The present invention may be also carried out by quenching after cooling to a temperature not below 600° C. and keeping at the temperature before quenching. The object of the present invention is well attainable by any of these processes.

Although the steel composition of the present invention is as mentioned above, the said steel may further contain either 0.01–0.5% of Ti or 0.01–0.15% of Nb or both. Also, the said steels with a content of 0.03–1.5% of Cr on the aforementioned basic chemical composition and/or 0.03–1.5% of Cr in addition to the aforesaid Ti and/or Nb are included in the technical scope of the present invention.

DESCRIPTION OF THE PREFERRED EMBODIMENTS

Figure 1A:
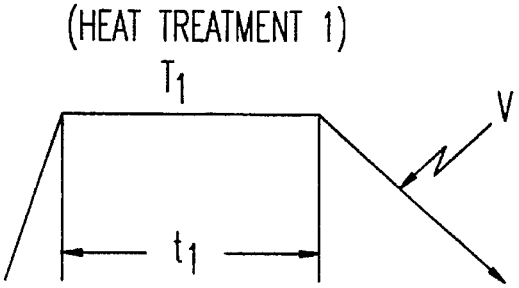
FIG. 1 shows the heat treatment pattern.

The present invention features specification of the chemical composition of the steel as well as the conditions of the heat treatment. But the chemical composition (including C-equivalent) and the heat treating conditions are correlated with each other as will be described below about the reason for each item specified. Of the heat treatment in the present invention described in the present specification, the steps of carburizing, carbonitriding or carburizing followed by carbonitriding and slowly-cooling may be called the heat treatment 1 and re-heating and the subsequent quenching may be called the heat treatment 2. It may also be that the aforementioned the heat treatments comprising heat treatment 1 are represented by the technical term "carburizing." The heat treatment 2 of the present invention may be in the following alternative patterns, which may be possibly called heat treatments 2A, 2B and 2C respectively.

Heat treatment 2A

In case that the parts are heated to a temperature above the $Ac_3$ transformation point and less than 850° C. and is kept at the same temperature before quenching.

Heat treatment 2B

In case that the parts are heated to a temperature above the $Ac_3$ transformation point and less than 850° C. and is once cooled to a temperature not below 600° C. before quenching.

Heat treatment 2C

In case that the parts are heated to a temperature above the $Ac_3$ transformation point and less than 850° C. cooled to a temperature not below 600° C., and is kept at the temperature before quenching.

C: 0.03–0.27%

C is an important element for ensuring the strength required for the core of the gear, and the content of C is required to be more than 0.03%. If its content is excessive, however, it not only traversely affects the toughness of the core of the gear but also interferes with the gear's machinability and cold forgeability. Hence, its upper limit has to be determined as above. In the heat treatment 2 of the present invention, it is often the case that the prequenching structure is a mixture of ferrite and austenite depending on the heating condition. The object of the present invention is attainable by quenching in each heat treatment to thereby make the mixed structure that of ferrite and martensite (and a small amount of bainite). When the distribution of the temperature according to the position of the carburized part in the heat-treating furnace is taken into consideration, another important factor is that the wider the region of ferrite and austenite in Fe—C phase diagram required for making the mixture of structure in the core of the gear (noncarburized portion), the easier heat control is in the present invention, and the upper limit was set at 0.27% taking all these into due consideration.

Si: 0.05–0.35%

Si is an important element as deoxidizer for molten steel, hence its lower limit is set at 0.05%. Meanwhile, if its content is excessive, the quantity of $SiO_2$-type inclusion is bound to be increased. This, in turn, causes deterioration of workability such as rolling fatigue resistance property, cold forgeability and machinability. Furthermore, intergranular oxidation during carburizing may result in a lowering of the bending fatigue strength or a lowering of the surface equilibrium carbon concentration to thereby interfere with progress of carburization. Hence, taking all these into consideration, the upper limit is therefor set at 0.35%.

Mn: 0.3–2.0%

Mn is added as a deoxidizer and as an element for improving steel's hardenability. The amount of Mn is required to be not less than 0.3% to be really effective, but, if it is more than 2.0%, there results a lowering of cold-forgeability and machinability .

S: Less than 0.03%

S is an element for improving machinability, its effect being dependent upon the content. The upper limit of its addition is, however, set at 0.03% for excessive addition, thereof adversely affects bending fatigue strength and cold forgeability.

Ni: 0.4–3.0%

Ni is a highly important element with regard to the present invention. That is, Ni is an effective element for ensuring hardenability in the carburized layer and the core portion as well as improvement of toughness. The required quantity to be added should be more than 0.4% for formation of a sufficient amount of retained austenite in the surface layer of the part after carburizing in the carburizing surface layer. The amount of austenite then formed is desired to be 5–50 volume %. The upper limit is set at 3.0%, for an excessive addition may cause deterioration of machinability and forgeability.

Mo: 0.1–1.0%

The effects of Mo content in steel may be cited (1) prevention of intergranular oxidation in the carburized layer in the course of carburization;

(2) ensuring hardenability of the carburized surface layer and the core portion; and (3) increase of equilibrium carbon concentration during carburization and formation of a proper amount of retained austenite in the surface layer due to Mo's effect of lowering the Ms point in the surface layer. In order to ensure these effects it is essential that the content of Mo be more than 0.1%. The upper limit is, however, set at 1.0%, for the above effects become saturated if Mo content exceeds 1.0%.

Al: 0.015–0.1%

Al has an effect to form AIN through combination with N in steel and also to prevent getting coarse of austenite crystals during carburization. In order to ensure this effect, its content is required to be more than 0.015%. The upper limit is, however, set at 0.1%, for the above effect becomes saturated as it exceeds 0.1%.

V: 0.03–0.5%

In a case where in the heat treatment 2, the heating conditions are such that a rise of temperature takes place in the core portion of the gear, the presence of V in steel causes a precipitation of carbides and nitrides of V in ferrite in the core structure in the aforementioned heating process. So, as a result, the strength of ferrite in the core structure increases in the quenching step of the heat treatment 2. In order to ensure such an effect it is essential that the content of V be not less than 0.03%. The upper limit is set at 0.5%; an excessive thereof is known to cause deterioration of machinability.

N: 0.004–0.02%

In steel, N combines with Al V, Ti etc. to form AlN, carbides, nitrides etc. of V, those of Ti and the like and the presence thereof exhibits the effect to control the growth austenite grain size with the progress of carburization in the heat treatment 1. The minimum quantity of N required for this effect is 0.004% and the effect increases with an increasing content of N until it saturates at the set upper limit of 0.02%.

Ti: 0.01–0.15%, Nb: 0.01–0.15%

Although Ti and Nb are arbitrary elements in steel according to the present invention, both of these combine with C and N in steel to form carbide and nitride to prevent coarseness of austenite grain size and contribute to fineness thereof. To obtain this effect, the minimum content required is 0.01% for both Ti and Nb. The upper limit is set at 0.15% for both; an excess thereof is known to cause deterioration of machinability. Ti and Nb are known to be effective in combination but either may be sufficiently effective as well.

Cr: 0.03–1.5%

Cr, too, is an arbitrary element but it is effective in improving the hardenability and its content is to be determined with the size of the parts, that is, the overall effect taken into due consideration. Its content required for sufficient attainment of the above effect is 0.03%, and above this limit, the attainable effect increases correspoding to its content. If it should exceed 1.5%, the extent of intergranular oxidation in the carburized layer in the carburizing step of the heat treatment 1 becomes unacceptably; hence this is taken as the upper limit.

C-equivalent: 0.5–1.2

C-equivalent is an important value for ensuring a sufficient core hardness after quenching and is required to be 0.5–1.2% for attainment of the object of the present invention. If it is less than.0.5, the core hardness is bound to be insufficient. This, in case of gears, causes lowering of, for example, bending fatigue strength or spalling strength of the tooth surface and sometimes even bending of teeth due to plastic deformation. Meanwhile, when the C-equivalent is too large, the core becomes too hard after quenching; hence 1.2 is set as the upper limit. If this upper limit (1.2) is exceeded, it results in too much core hardness and a lowering of the core's toughness and in case of gears, for example, the impact strength is lowered.

Although case hardening steel used in the present invention is required to satisfy the aforementioned chemical composition, it is permissible to contain some elements as impurities other than the aforementioned elements. P and O, whose permissible content may roughly be P<0.03% and O<0,002% respectively, may be cited as such elements.

Heat treatment 1

What is done in the heat treatment 1 is essentially carburizing. When carburizing is done in a RX gas(endothermic) atmosphere and nitriding is done in a mixed atmosphere of RX gas+ammonia gas, carburizing and nitriding progress simultaneously (generally called carbonitriding). When the aforementioned nitriding atmosphere is formed in the latter half of the carburizing step, carburizing and nitriding progress in parallel after carburizing has made progress half-way (generally called carburizing followed by carbonitriding). In this specification, however, these forms of treatments are represented by the term "carburization."

The heat treatment 1 of the Present invention may be any of these and may be carried out under already-established conditions (heating temperature, atmospheric gas, heating time). For the purpose of carburization heating temperature is above $Ac_3$ transformation point and below 1,050° C. or, if necessary, below 980° C. If it is below the $Ac_3$, insufficient diffusion makes carburization insufficient. Meanwhile, if the heating temperature should exceed 1,050° C., the life of the carburizing furnace is suddenly shortened. The time required for carburization is sufficient if it can ensure the effective depth of carburization but generally a range of 2–15 hours may be required depending on the kind and size of the part to be treated.

In this invention the rate of cooling after carburization is important. It is preferable for it to be of slowly-cooling at a rate less than 100° C./min. instead of conventional quenching. This is because control at a slow cooling rate raises ferrite's dislocation density in the core structure. This not only enhances the strength but also facilitates precipitation of the elements important for the carburized steel of the present invention, such as Mo and V. These elemensts dissolved in ferrite at this stage when the core is heated in the subsequent heat treatment 2 at the raised temperature contribute to the hardening of ferrite in the core structure. Of course, however, it does not mean that further elucidation of the ferrite hardening mechanism determine the technical scope of the invention. If the cooling rate at this time should exceed 100° C./min., the volume of martensite in the carburized layer and the core, increases causing size distortion; hence, the cooling rate should be controlled at below 100° C./min. As to the lower limit, there is no particular limit but considering the conditions of industrial manufacture, it is advisable to set it in the vicinity of 1° C./min. The core structure after carburization in the heat treatment 1 is ferrite+pearlite when the cooling rate is sufficiently low, and as the cooling rate is increased, it first changes to ferrite+pearlite+bainite, then to ferrite+pearlite+martensite and finally to bainite (coexisting with martensite). Of these, the most common is a structure based on bainite, but it is, as mentioned above, a structure which causes enhancement of the ferrite's strength when the heat treatment 2 is over and upon completion of a subsequent tempering.

The part having undergone the heat treatment 1 has its C-concentration decreasing with increasing depth. According to the present invention, however, the layer down to where C-concentration is 0.4% is called the carburizing layer or the surface layer and the deeper layer or portion is called the core. The C-concentration of the core is, therefore, as stipulated for the case-hardening steel of the present invention.

Heat Treatment 2

The basic idea of the heat treatment 2 is to reheat the carburized layer resulting from the heat treatment 1 for conversion into austenite and then re-converting by quenching the carburized layer into a mixed structure of martensite+retained austenite. The heat treatments 2A, 2B and 2C have this basic idea in common. As a means of making the aforementioned austenite in the carburized layer, a method of heating the steel to above the $Ac_3$ transformation temparature where C in its chemical composition is 0.4% (at the deepest level of the aforementioned effective carburized layer)is used. If the heating temperature is too high, in excess of 850° C., the volume of martensite in the core after quenching is increased, thus resulting in increased size distortion and failure to accomplish the object of the present invention.

If the aforementioned heating conditions should be satisfied, the core may be heated or not heated. Heating methods are, among others, the carbonitriding method, the high/medium frequency heating method, the bright heat treatment method, the nitrocarburizing heat treatment method and the nitriding heat treatment method, while a non-heated method is the high frequency quenching method. Needless to say, some other methods than those mentioned above may be usable, and for the application of such methods, any known technique may be freely adopted. The core is heated in the heat treatment 2, and since the temperature reached by heating of the carburized layer is between the $Ac_3$ transformation point and 850° C., the core is converted into a structure of ferrite+austenite. It is then re-converted by quenching into a mixture of ferrite+martensite (partially bainite), and this ferrite (including ferrite contained in bainite) exhibit a high strength. When the core is not heated, the core structure resulting from slowly-cooling in the heat treatment 1 remains unaffected and the core strength is maintained at the desired level.

After heating to a temperature range of between the $Ac_3$ transformation point and 850° C., quenching may be done immediately, or quenching may be done after a short time of slowly-cooling, or after keeping at the level reached by slowly-cooling before quenching. It is important that the temperature reached by slow-cooling is not less than 600° C., for otherwise it means cooling down to the $Ar_3$ transforming temperature when the C-content in the steel's composition is 0.4%, thus resulting in ferrite+pearlite transformation or bainite transformation, failure to form martensite even by subsequent quenching and failure to accomplish the object of the present invention.

Known methods as water quenching and oil quenching may be used, and adoption of the so-called mar-quenching method (quenching—holding at a given temperature—slow-cooling), too, is included in the present invention. Using these methods the carburized layer is formed as a mixture of martensite and retained austenite.

It is desirable to choose heating atmosphere for the heat treatment 2 the composition of which does not cause a lowering of the C- or N-concentration of the carburized layer or the carbonitriding layer, that is, an atmosphere not causing decarburization or denitrization. More desirably, it is also possible to adopt a nitriding atmosphere as a heating atmosphere for the heat treatment 2, or a mixed atmosphere, for example, RX gas+ammonia gas.

The steel parts, with which quenching in the heat treatment 2 is over, can well be used as it is, but, if desired, it may further be tempered or subjected to shot peening for further improvement of its fatigue strength.

EXAMPLE

Rolled bar steels of chemical compositions shown in Table 1 and Table 2 were prepared.

TABLE 1

| Steel No. | | C | Si | Mn | S | Ni | Cr | Mo | Al | V | Ti | Nb | N | C eg. |
|---|---|---|---|---|---|---|---|---|---|---|---|---|---|---|
| 1 | comparative steel | 0.02 | 0.10 | 0.72 | 0.009 | 1.65 | — | 0.35 | 0.026 | 0.21 | — | — | 0.009 | 0.604 |
| 2 | invention steel | 0.05 | 0.08 | 0.71 | 0.007 | 1.80 | — | 0.37 | 0.025 | 0.19 | — | — | 0.008 | 0.639 |
| 3 | invention steel | 0.15 | 0.10 | 0.75 | 0.008 | 1.70 | — | 0.40 | 0.030 | 0.20 | — | — | 0.010 | 0.749 |
| 4 | invention steel | 0.23 | 0.09 | 0.77 | 0.014 | 1.75 | — | 0.36 | 0.032 | 0.22 | — | — | 0.011 | 0.845 |
| 5 | comparative steel | 0.35 | 0.12 | 0.79 | 0.015 | 1.78 | — | 0.40 | 0.027 | 0.19 | — | — | 0.009 | 0.964 |
| 6 | comparative steel | 0.13 | 0.02 | 0.71 | 0.008 | 1.66 | — | 0.36 | 0.029 | 0.18 | — | — | 0.009 | 0.684 |
| 7 | invention steel | 0.16 | 0.07 | 0.75 | 0.013 | 1.74 | — | 0.39 | 0.031 | 0.21 | — | — | 0.008 | 0.765 |
| 8 | invention steel | 0.14 | 0.25 | 0.80 | 0.012 | 1.79 | — | 0.43 | 0.025 | 0.19 | — | — | 0.010 | 0.781 |
| 9 | comparative steel | 0.15 | 0.50 | 0.79 | 0.011 | 1.80 | — | 0.41 | 0.027 | 0.20 | — | — | 0.011 | 0.828 |
| 10 | comparative steel | 0.14 | 0.08 | 0.20 | 0.013 | 1.76 | — | 0.41 | 0.029 | 0.19 | — | — | 0.011 | 0.625 |
| 11 | invention steel | 0.15 | 0.09 | 0.43 | 0.010 | 1.80 | — | 0.40 | 0.026 | 0.20 | — | — | 0.010 | 0.694 |
| 12 | invention steel | 0.13 | 0.11 | 1.45 | 0.007 | 1.77 | — | 0.39 | 0.035 | 0.19 | — | — | 0.009 | 0.877 |
| 13 | comparative steel | 0.15 | 0.13 | 2.50 | 0.009 | 1.76 | — | 0.36 | 0.031 | 0.21 | — | — | 0.012 | 1.126 |
| 14 | comparative steel | 0.15 | 0.10 | 0.71 | 0.007 | 0.28 | — | 0.36 | 0.031 | 0.19 | — | — | 0.011 | 0.538 |
| 15 | invention steel | 0.16 | 0.09 | 0.75 | 0.007 | 0.82 | — | 0.41 | 0.035 | 0.20 | — | — | 0.009 | 0.642 |
| 16 | invention steel | 0.14 | 0.07 | 0.79 | 0.010 | 2.50 | — | 0.37 | 0.027 | 0.20 | — | — | 0.008 | 0.844 |
| 17 | comparative steel | 0.15 | 0.11 | 0.72 | 0.011 | 3.50 | — | 0.38 | 0.029 | 0.19 | — | — | 0.013 | 0.974 |
| 18 | comparative steel | 0.13 | 0.13 | 0.71 | 0.006 | 1.72 | — | 0.05 | 0.024 | 0.18 | — | — | 0.011 | 0.654 |

TABLE 2

| Steel No. | | C | Si | Mn | S | Ni | Cr | Mo | Al | V | Ti | Nb | N | C eg. |
|---|---|---|---|---|---|---|---|---|---|---|---|---|---|---|
| 19 | invention steel | 0.14 | 0.11 | 0.78 | 0.006 | 1.79 | — | 0.30 | 0.025 | 0.20 | — | — | 0.012 | 0.742 |
| 20 | invention steel | 0.14 | 0.10 | 0.75 | 0.008 | 1.75 | — | 0.70 | 0.032 | 0.21 | — | — | 0.011 | 0.664 |
| 21 | comparative steel | 0.15 | 0.09 | 0.74 | 0.008 | 1.76 | — | 1.20 | 0.030 | 0.19 | — | — | 0.012 | 0.885 |
| 22 | comparative steel | 0.14 | 0.08 | 0.73 | 0.010 | 1.66 | — | 0.36 | 0.027 | 0.02 | — | — | 0.010 | 0.600 |
| 23 | invention steel | 0.14 | 0.10 | 0.74 | 0.013 | 1.70 | — | 0.41 | 0.030 | 0.10 | — | — | 0.009 | 0.672 |
| 24 | invention steel | 0.15 | 0.09 | 0.80 | 0.012 | 1.69 | — | 0.40 | 0.029 | 0.45 | — | — | 0.010 | 0.923 |
| 25 | comparative steel | 0.18 | 0.08 | 0.79 | 0.012 | 1.65 | — | 0.39 | 0.027 | 0.74 | — | — | 0.013 | 1.136 |
| 26 | invention steel | 0.15 | 0.11 | 0.77 | 0.014 | 1.00 | — | 0.41 | 0.030 | 0.32 | — | — | 0.012 | 0.743 |
| 27 | invention steel | 0.15 | 0.11 | 0.77 | 0.015 | 1.97 | — | 0.41 | 0.032 | 0.32 | — | — | 0.011 | 0.872 |
| 28 | comparative steel | 0.29 | 1.02 | 1.02 | 0.013 | 1.97 | — | — | 0.033 | — | — | — | 0.011 | 0.907 |
| 29 | comparative steel | 0.39 | 1.01 | 0.78 | 0.014 | 0.01 | — | 0.41 | 0.037 | 0.31 | — | — | 0.010 | 0.971 |
| 30 | comparative steel | 0.15 | 0.05 | 0.66 | 0.022 | 0.02 | — | 0.41 | 0.025 | — | — | — | 0.009 | 0.368 |
| 31 | comparative steel | 0.21 | 0.10 | 0.79 | 0.016 | 0.01 | — | 0.41 | 0.028 | — | — | — | 0.011 | 0.460 |
| 32 | invention steel | 0.15 | 0.09 | 0.74 | 0.007 | 1.70 | 0.2 | 0.39 | 0.030 | 0.20 | — | — | 0.009 | 0.777 |
| 33 | invention steel | 0.15 | 0.10 | 0.75 | 0.007 | 1.68 | 1.1 | 0.38 | 0.028 | 0.20 | — | — | 0.012 | 0.926 |
| 34 | invention steel | 0.14 | 0.08 | 0.75 | 0.008 | 1.66 | — | 0.35 | 0.026 | 0.18 | 0.051 | — | 0.012 | 0.709 |

TABLE 2-continued

| Steel No. | | C | Si | Mn | S | Ni | Cr | Mo | Al | V | Ti | Nb | N | C eg. |
|---|---|---|---|---|---|---|---|---|---|---|---|---|---|---|
| 35 | invention steel | 0.15 | 0.11 | 0.76 | 0.007 | 1.65 | — | 0.36 | 0.025 | 0.19 | — | 0.053 | 0.011 | 0.732 |
| 36 | invention steel | 0.15 | 0.10 | 0.79 | 0.009 | 1.65 | — | 0.40 | 0.030 | 0.19 | 0.025 | 0.031 | 0.012 | 0.744 |

Rolled bars (70 mm in diameter) of chemical compositions shown in Tables 1 and 2 were prepared after hot forging and gears of the following data were prepared.

Number of teeth: 73

Normal Module : 2.25

Pressure angle : 14 30'

Helix angle : 26 45'

Root diameter : 175.8 mm

Figure 1B:
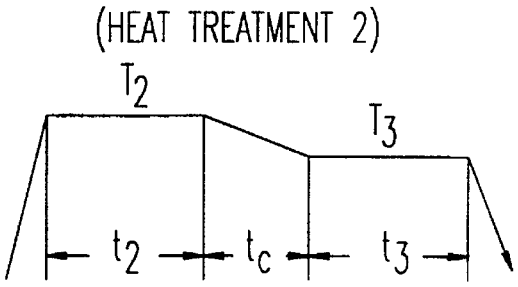

Each of these gears was subjected to the heat treatments 1 and 2. Symbols in Table 3 are shown in FIG. 1. The heat treatment 2 was carried out in a RX atmosphere safe from decarburization or denitrization.

TABLE 3

| | conditions of heat treatment | | | | | | | | |
|---|---|---|---|---|---|---|---|---|---|
| Steel No. | T1 (°C.) | t1 (hr) | T2 (°C.) | t2 (min) | tc (min) | T3 (°C.) | t3 (min) | V (°C./min) | Temperature for oil quenching (°C.) |
| 1~13 | 930 | 2.5 | 780 | 20 | 20 | 720 | 20 | 30 | 150 |
| 15~25 | 930 | 2.5 | 750 | 20 | 15 | 680 | 0 | 20 | 150 |
| 14, 26~36 | 930 | 2.5 | 750 | 30 | 0 | 750 | 30 | 15 | 150 |

Figure 2:
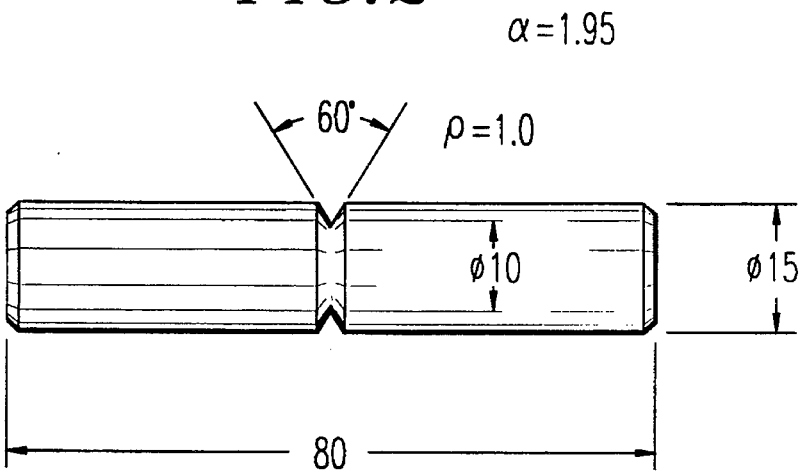
FIG. 2 shows a test piece for the rotating bending fatigue test.

After heat treatment the extent of variation of the lead error before and after the heat treatment was measured with each trially made gear and the bending fatigue strength test were carried out. The core hardness of the gear was measured to be 1 mm inward of root circle. The rotating bending fatigue strength was measured for a test piece as shown in FIG. 2. The test piece was heat-treated in the same procedure as described above and after shot peening by means of an air nozzle. The shot peening conditions were as follows.

Shot size : 0.6 mm in diameter

Shot hardness: HRC 53–58

Air pressure: 5.5 kgf/cm$^2$

Exprosure time: 30 sec./15 rpm.

Exprosure distance: 100 mm

Peening point: 1 point (Notch center)

The results of these tests are shown in Tables 4 and 5.

TABLE 4

| Steel No. | | Core hardness (Hv) | Amount of changes of the lead error before and after the heat treatment (μm) | Rotating bending fatigue strength (kgf/mm$^2$) |
|---|---|---|---|---|
| 1 | comparative steel | 197 | 8 | 60 |
| 2 | invention steel | 232 | 7 | 72 |
| 3 | invention steel | 248 | 7 | 73 |
| 4 | invention steel | 323 | 9 | 73 |
| 5 | comparative steel | 413 | 16 | 69 |
| 6 | comparative steel | 234 | 7 | 66 |
| 7 | invention steel | 252 | 5 | 73 |

TABLE 4-continued

| Steel No. | | Core hardness (Hv) | Amount of changes of the lead error before and after the heat treatment (μm) | Rotating bending fatigue strength (kgf/mm$^2$) |
|---|---|---|---|---|
| 8 | invention steel | 255 | 8 | 74 |
| 9 | comparative steel | 262 | 9 | 63 |
| 10 | comparative steel | 225 | 10 | 65 |
| 11 | invention steel | 238 | 8 | 73 |

TABLE 4-continued

| Steel No. | | Core hardness (Hv) | Amount of changes of the lead error before and after the heat treatment (μm) | Rotating bending fatigue strength (kgf/mm$^2$) |
|---|---|---|---|---|
| 12 | invention steel | 273 | 9 | 70 |
| 13 | comparative steel | 321 | 11 | 69 |
| 14 | comparative steel | 185 | 5 | 57 |
| 15 | invention steel | 225 | 9 | 73 |
| 16 | invention steel | 269 | 10 | 71 |
| 17 | comparative steel | 295 | 11 | 69 |
| 18 | comparative steel | 219 | 7 | 59 |

TABLE 5

| Steel No. | | Core hardness (Hv) | Amount of changes of the lead error before and after the heat treatment (μm) | Rotating bending fatigue strength (kgf/mm$^2$) |
|---|---|---|---|---|
| 19 | invention steel | 245 | 10 | 72 |
| 20 | invention steel | 269 | 8 | 75 |
| 21 | comparative steel | 297 | 10 | 71 |
| 22 | comparative steel | 199 | 6 | 61 |
| 23 | invention steel | 224 | 8 | 69 |
| 24 | invention steel | 309 | 9 | 72 |
| 25 | comparative steel | 373 | 10 | 70 |
| 26 | invention steel | 259 | 5 | 73 |
| 27 | invention steel | 286 | 7 | 74 |

TABLE 5-continued

| Steel No. | | Core hardness (Hv) | Amount of changes of the lead error before and after the heat treatment (μm) | Rotating bending fatigue strength (kgf/mm²) |
|---|---|---|---|---|
| 28 | comparative steel | 430 | 17 | 68 |
| 29 | comparative steel | 355 | 15 | 66 |
| 30 | comparative steel | 149 | 7 | 52 |
| 31 | comparative steel | 163 | 8 | 55 |
| 32 | invention steel | 249 | 6 | 72 |
| 33 | invention steel | 259 | 8 | 72 |
| 34 | invention steel | 238 | 7 | 75 |
| 35 | invention steel | 243 | 4 | 76 |
| 36 | invention steel | 246 | 5 | 76 |

Even when the conditions of heat treatment 1 and 2 were satisfactory for the present invention, as seen from Tables 1–5, the core hardness, variation in the extent of lead error and the rotating bending fatigue strength were inferior to those of the steel of the present invention when the chemical composition of the steel did not satisfy the conditions for the present invention.

Figure 4A:
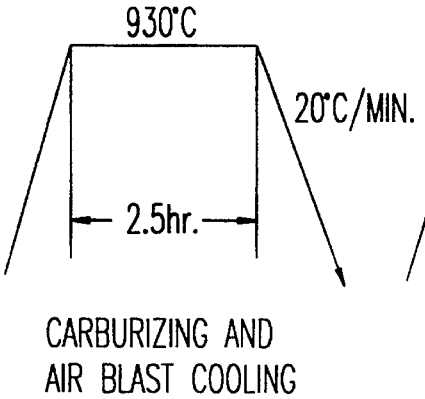
FIG. 4 shows the heat treatment pattern.
Figure 4B:
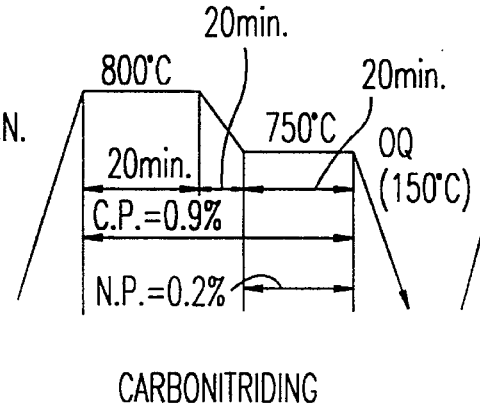
Figure 4C:
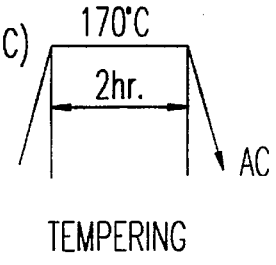

Then, tests were made under the same conditions as above in alternative cases where steels Nos. 30 and 31 were heat-treated under conventional carburizing conditions, steel No. 27 was carbonitrided under the conditions shown in FIG. 4 and steel No. 27 was high frequency-quenched in the heat treatment 2. The results of these tests are summed up in Table 6.

TABLE 6

Figure 3A:
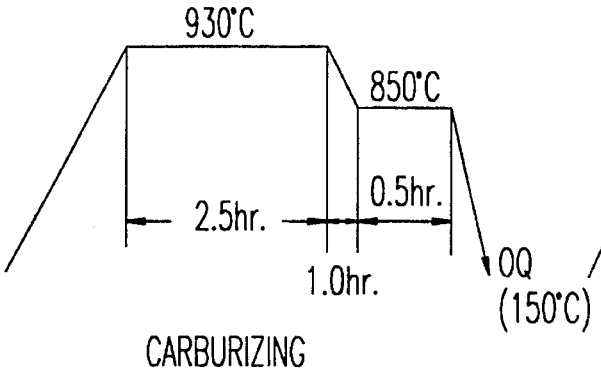
FIG. 3 shows the heat treatment pattern.
Figure 3B:
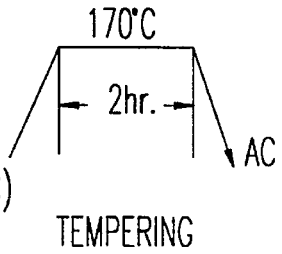

| Steel No. | Heat pattern | Core hardness (Hv) | Amount of changes of the lead error before and after heat treatment (μm) | Rotating bending fatigue strength (kgf/mm²) |
|---|---|---|---|---|
| 30 | FIG. 3 | 323 | 22 | 74 |
| 31 | FIG. 3 | 359 | 29 | 71 |
| 27 | FIG. 4 | 305 | 6 | 76 |
| 27 | Induction Hardening | 292 | 10 | 71 |

With the steel No. 27, which satisfies the chemical composition of the present invention, good results were obtained even when the heat treating means were changed within a certain range of conditions for the heat treatment 1 and 2.

Figure 5:
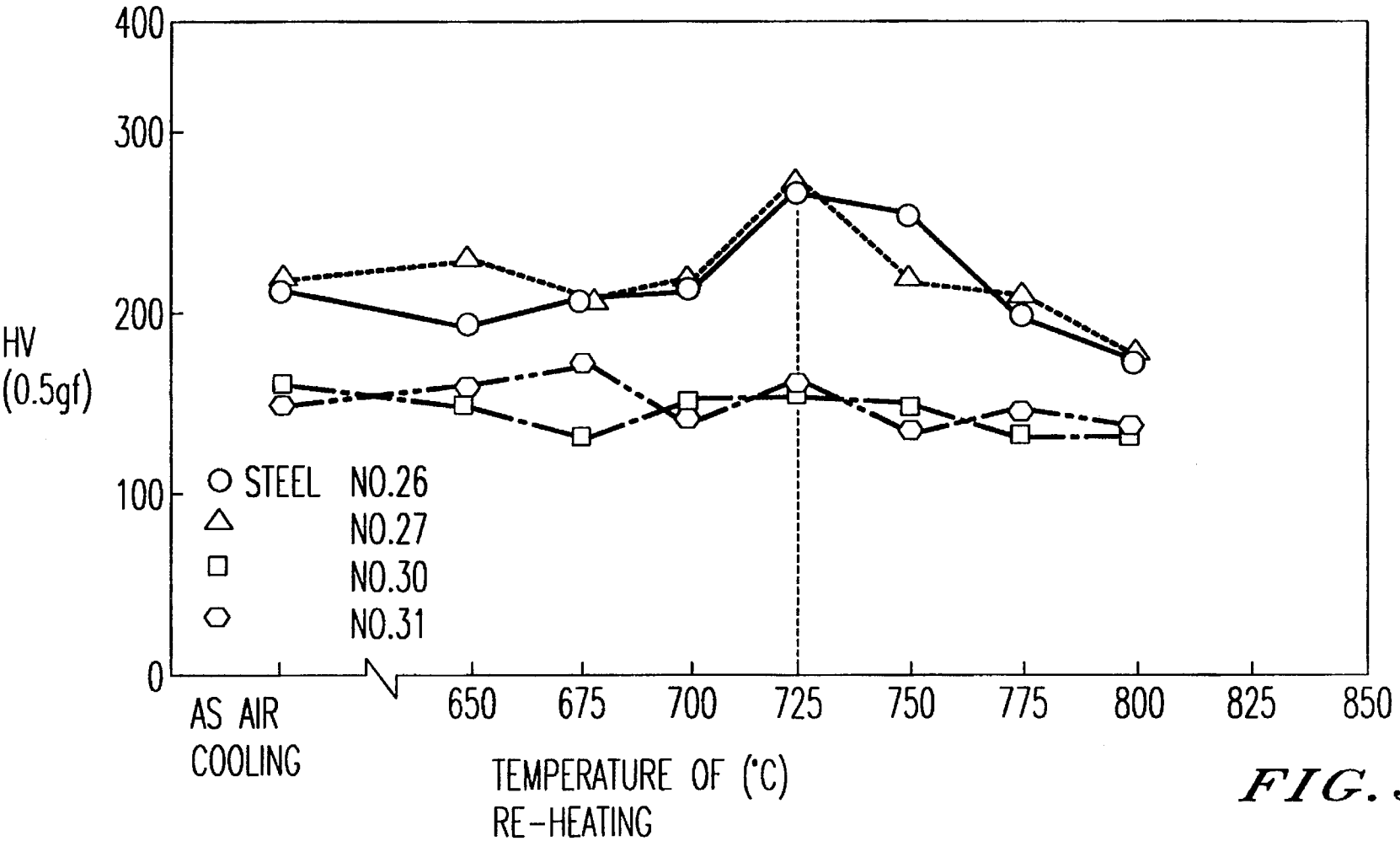
FIG. 5 is a graph showing the effect of the re-heating temperature on hardness of ferrite in the heat treatment 2.

Then forged rods of steels Nos. 26 and 27 (both of the present invention) and steels Nos. 30 and 31 (both comparative steels) were used, and after the heat treatment 1 (920° C. ×1 hour, air-cooling) and reheating (heating temperature as graduated on the abscissa of FIG. 5, heating time: 30 min., this followed by oil quenching at 120° C. ) the hardness of the ferrite part was measured under a load of 0.5 gf. The result was as shown in FIG. 5, but it is to be noted that, while with the comparative steels there was no rise of Hv(Vickers Hardness) even after re-heating, with the steels of the invention the effect of enhancing precipitation is ensured even when quenching is made after heating to above the $Ac_1$ transformation point.

Parts using as case-hardening steel which satisfy the chemical composition of the present invention exhibit only a small amount of heat treatment distortion are excellent according to the results of the rotating bending fatigue test and are high in core hardness. Hence, case-hardened parts with little distortion which have excellence in bending fatigue strength qualities are obtainable.

What we claim are:

1. A manufacturing method of a case-hardened material with little distortion during heat treatment comprising an uncarburized core and a carburized surface layer, comprising the steps of carburizing, carbonitriding or carburizing followed by carbonitriding parts made of a case-hardening steel, whose chemical composition is C:0.03–0.27 wt. %, Si: 0.05–0.35 wt. %, Mn: 0.3–2.0 wt. %, S: 0.3 wt. % and less, Ni: 0.4–3.0 wt. %, Mo: 0.1–1.0 wt. %, Al: 0.015–0.10 wt. %, V: 0.03–0.5 wt. %, and N: 0.004–0.02 wt. %, the balance Fe and inevitable impurities, wherein the C-equivalent represented by the following formula is in the range 0.5–1.2 (wt. %), $$\text{C-equivalent}=[C]+(1/7.2)\,[Si]+(1/4.8)\,[Mn]+(1/7.5)\,[Ni]+(1/6.0)\,[Cr]+(1/5.8)\,[Mo]+(1/1.5)\,[V]$$

wherein, in the above formula, each bracketed element represents the content thereof in weight percentage, cooling said parts at a rate of from 100° C./min. to 1° C./minute, and then reheating and quenching in a manner selected from the following heat treatment conditions (1), (2) or (3) to form a carburized surface layer having a mixed phase structure comprising martensite and retained austenite and an uncarburized core having a mixed phase structure comprising ferrite and martensite or ferrite, martensite and bainite, (1) heating said parts at a temperature which is greater than the $Ac_3$ transformation point of the carburized surface layer having a C-content of at least 0.4% by weight but which is less than 850° C., retaining the parts at said temperature and then quenching, (2) heating and retaining said parts at said temperature designated in case (1) above, cooling to a temperature not less than 600° C. and then quenching, (3) heating and retaining said parts at said temperature designated in case (1) above, cooling to a temperature not less than 600° C., retaining said parts at said temperature not less than 600° C., and then quenching.

2. The manufacturing method according to claim 1, wherein reheating and quenching is accomplished according to heat treatment condition 1 and wherein said material is a case-hardening steel whose chemical composition comprises at least one of 0.01–0.15% of Ti and 0.01–0.15% of Nb.

3. The manufacturing method according to claim 1, wherein reheating and quenching is accomplished according to heat treatment condition 2 and wherein said material is a case-hardening steel whose chemical composition comprises at least one of 0.01–0.15% of Ti and 0.01–0.15% of Nb.

4. The manufacturing method according to claim 1, wherein reheating and quenching is accomplished according to heat treatment condition 3 and wherein said material is a case-hardening steel whose chemical composition comprises at least one of 0.01–0.15% of Ti and 0.01–0.15% of Nb.

5. The manufacturing method according to claim 1, wherein the cooling positive rate is 1° C./min.

6. The manufacturing method according to any of claims 2, 3, 4, or 5 or 1, wherein said material is a case-hardening steel whose chemical composition comprises of 0.03–1.5% of Cr.

* * * * *